US011396990B2

(12) United States Patent
Lee et al.

(10) Patent No.: US 11,396,990 B2
(45) Date of Patent: Jul. 26, 2022

(54) PHOSPHOR MODULE

(71) Applicant: LG Electronics Inc., Seoul (KR)

(72) Inventors: Jongmoo Lee, Seoul (KR); Eunyoung Kim, Seoul (KR); Mongkwon Jung, Seoul (KR); Byungwoo Jeoung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/061,063

(22) Filed: Oct. 1, 2020

(65) Prior Publication Data

US 2021/0018155 A1 Jan. 21, 2021

Related U.S. Application Data

(63) Continuation of application No. PCT/KR2019/004536, filed on Apr. 16, 2019.

(60) Provisional application No. 62/658,601, filed on Apr. 17, 2018.

(51) Int. Cl.

| | |
|---|---|
| ***F21S 41/176*** | (2018.01) |
| ***F21S 41/40*** | (2018.01) |
| ***F21S 41/365*** | (2018.01) |
| ***F21S 41/16*** | (2018.01) |
| ***F21S 41/37*** | (2018.01) |
| ***F21S 45/47*** | (2018.01) |
| ***F21S 41/20*** | (2018.01) |
| ***F21V 3/06*** | (2018.01) |

(52) U.S. Cl.

CPC ..... *F21S 41/40* (2018.01); *F21S 41/16* (2018.01); *F21S 41/176* (2018.01); *F21S 41/285* (2018.01); *F21S 41/365* (2018.01); *F21S 41/37* (2018.01); *F21S 45/47* (2018.01); *F21V 3/0615* (2018.02)

(58) Field of Classification Search

CPC ..... F21S 41/176; F21S 43/16

See application file for complete search history.

(56) References Cited

U.S. PATENT DOCUMENTS

| | | | | |
|---|---|---|---|---|
| 2015/0252964 | A1* | 9/2015 | Takahashi | F21K 9/64 362/84 |
| 2019/0024854 | A1* | 1/2019 | Annen | F21S 41/00 |

FOREIGN PATENT DOCUMENTS

| | | |
|---|---|---|
| JP | 2012119193 | 6/2012 |
| JP | 2014052606 | 3/2014 |
| JP | 2014199267 | 10/2014 |
| JP | 2016027613 | 2/2016 |
| KR | 101628454 | 6/2016 |
| KR | 1020180004579 | 1/2018 |

* cited by examiner

*Primary Examiner* — Sean P Gramling

(74) *Attorney, Agent, or Firm* — Fish & Richardson P.C.

(57) ABSTRACT

A phosphor module for a laser light source includes a radiating body, a phosphor layer disposed at the radiating body, the phosphor layer being configured to absorb light having a first wavelength and emit light having a second wavelength different from the first wavelength, a reflective layer that surrounds a side surface of the phosphor layer and is configured to reflect light, and a black matrix layer disposed at the reflective layer and configured to absorb light. The black matrix layer is disposed at an edge of the phosphor layer.

19 Claims, 6 Drawing Sheets

PHOSPHOR MODULE

CROSS-REFERENCE TO RELATED APPLICATIONS

This application is a continuation of International Application No. PCT/KR2019/004536, filed on Apr. 16, 2019, which claims the benefit of U.S. Provisional Application No. 62/658,601, filed on Apr. 17, 2018. The disclosures of the prior applications are incorporated by reference in their entirety.

TECHNICAL FIELD

The present disclosure relates to a phosphor module for a laser light source.

BACKGROUND

A vehicle may include a lamp. For example, as shown FIG. 1, a vehicle 1 may include a lamp device 100 for providing driver's visibility or notifying other vehicles of the driving state of the vehicle 1 when ambient light is low during driving.

In some examples, a vehicle lamp device may include a head lamp provided at a front side of the vehicle and a rear lamp provided at a rear side of the vehicle. The head lamp may illuminate the front side during night driving. The rear lamp may include a brake lamp that is turned on when the driver operates a brake and a turn signal lamp that informs the advancing direction of the vehicle.

In some cases, a vehicle may use a laser light source. For example, as shown in FIG. 3, the lamp device 100 may include a laser light source 10, which may have an improved energy efficiency. In some cases, light emitted from a laser diode may be excellent in straightness, and an irradiation distance of the lamp may increase without interfering visibility of oncoming vehicles.

In some examples, a white lamp may be implemented using a laser diode.

For example, white light may be generated by mixing light emitted from three types of laser diodes. Here, the three types of laser diodes may emit three primary colors of light, respectively.

In some cases, white light may be generated by converting light emitted from a blue laser diode into yellow light, and then mixing the yellow light with light emitted from the blue laser diode. In this way, white light may be implemented using a single type of laser.

In some examples, a phosphor may be used for light conversion of blue light emitted from a laser diode. The laser diode emits light with high output power, and the temperature of the phosphor may rise above 150° C. when light emitted from the laser diode is photo-converted.

In some cases of a resin phosphor, a phosphor-in-glass (PIG; hereinafter, referred to as a "glass phosphor") may be used in an LED light source. In some cases, thermal quenching may occur during the light conversion process of laser light.

In some cases, yellow light converted from the phosphor may be scattered to spread widely, and part of the yellow light converted from the phosphor may be emitted to the outside. For example, yellow light emitted to the periphery of a light emitting area of the laser light source may generate a "yellow ring."

SUMMARY

The present disclosure describes a structure for minimizing a yellow ring generated from a phosphor module.

The present disclosure also describes a structure for minimizing blue noise generated from the phosphor module.

The present disclosure further describes a structure for increasing the light uniformity of a light source.

According to one aspect of the subject matter described in this application, a phosphor module for a laser light source includes a radiating body, a phosphor layer disposed at the radiating body, the phosphor layer being configured to absorb light having a first wavelength and emit light having a second wavelength different from the first wavelength, a reflective layer that surrounds a side surface of the phosphor layer and is configured to reflect light, and a black matrix layer disposed at the reflective layer and configured to absorb light. The black matrix layer is disposed at an edge of the phosphor layer.

Implementations according to this aspect may include one or more of the following features. For example, the black matrix layer may extend to the phosphor layer to thereby overlap with a portion of the phosphor layer. In some examples, the reflective layer may include a first reflective layer in contact with the side surface of the phosphor layer, and a second reflective layer that surrounds the first reflective layer. The black matrix layer may be disposed at both of the first reflective layer and the second reflective layer.

In some implementations, the radiating body may define a recess portion that is recessed from a top surface of the radiating body and accommodates the phosphor layer and the reflective layer. In some examples, the black matrix layer may extend from the reflective layer to an upper portion of the radiating body. In some implementations, the black matrix layer may be made of a mixture including carbon black and a glass frit or a polymer material, and the black matrix layer may be coated on the reflective layer and has a thickness of 5 to 30 μm.

In some examples, the black matrix layer may be a diamond-like carbon (DLC) coating layer having a thickness of 1.5 to 3 μm. In some examples, the black matrix layer may be made of metal nitride or metal oxide including two or more metal elements, and the black matrix layer may be coated on the reflective layer and has a thickness of 1.5 to 10 μm.

In some implementations, the phosphor module may further include a diffuser layer disposed on the phosphor layer and configured to scatter light. In some examples, the reflective layer may extend to a side surface of the diffuser layer. In some examples, the diffuser layer may cover at least a part of an upper surface of the reflective layer. In some examples, the diffuser layer may be made of porous silica and a glass frit, and has a thickness of 20 to 100 μm.

In some implementations, the top surface of the radiating body may be flush with a top surface of the reflective layer and a top surface of the phosphor layer. In some examples, the black matrix layer may be disposed outside of the phosphor layer. In some implementations, the radiating body may be made of metal or a metal alloy and configured to dissipate heat generated from the phosphor layer, and the reflective layer may be made of metal oxide.

In some implementations, the phosphor module may further include an adhesive layer disposed between an upper surface of the radiating body and bottom surfaces of the reflective layer and the phosphor layer. In some examples, the reflective layer and the phosphor layer may be attached to an upper surface of the adhesive layer. In some examples, the black matrix layer may extend from the side surface of the phosphor layer to an outer edge of the reflective layer, and the outer edge of the reflective layer may be disposed at an outer surface of the adhesion layer.

In some implementations, the phosphor module may further include a diffuser layer disposed on an upper surface of the phosphor layer and configured to scatter light, where the diffuser layer is in contact with the black matrix layer. In some examples, the diffuser layer may extend to an upper surface of the reflective layer.

DETAILED DESCRIPTION

Figure 1:
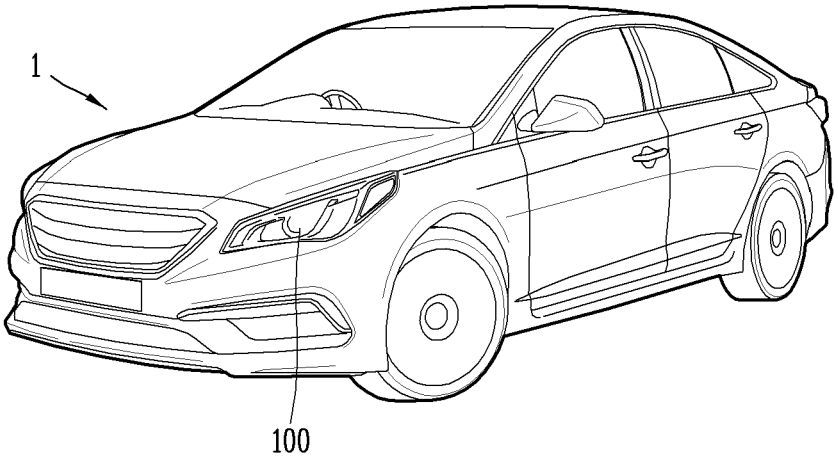
FIG. 1 is a conceptual view showing a vehicle.
Figure 2:
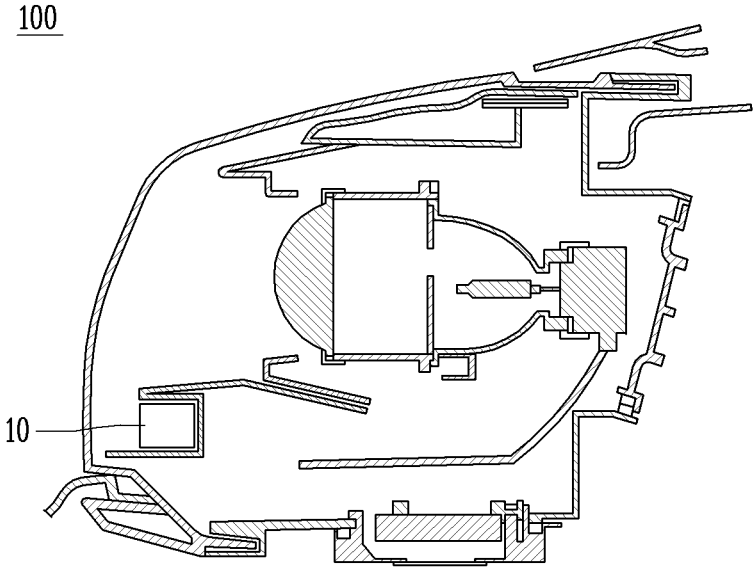
FIG. 2 is a cross-sectional view showing a lamp device included in a vehicle.

Hereinafter, the implementations disclosed herein will be described in detail with reference to the accompanying drawings, and the same or similar elements are designated with the same numeral references regardless of the numerals in the drawings and their redundant description will be omitted.

Prior to describing a phosphor module, a laser light source used for the phosphor module according to the present disclosure will be described.

Figure 3:
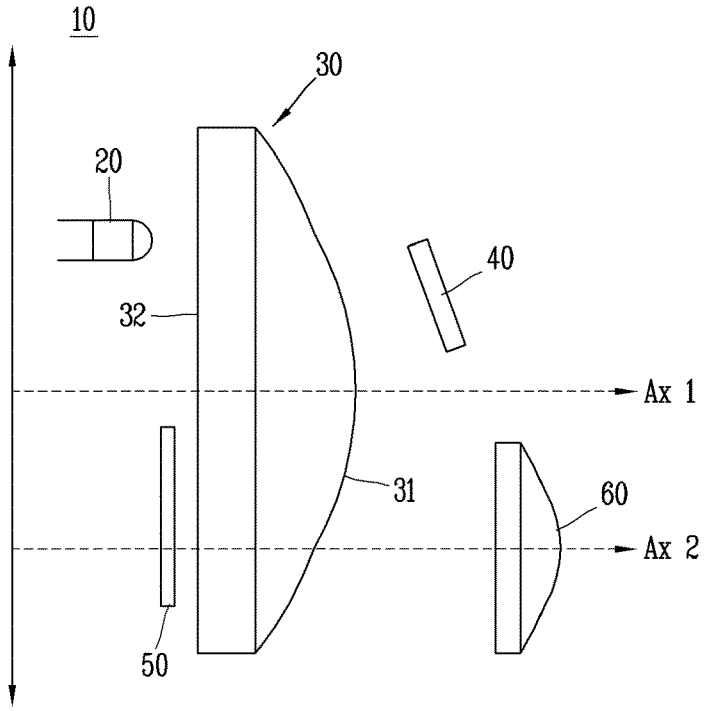
FIG. 3 is a conceptual view showing a reflective laser light source.
Figure 4:
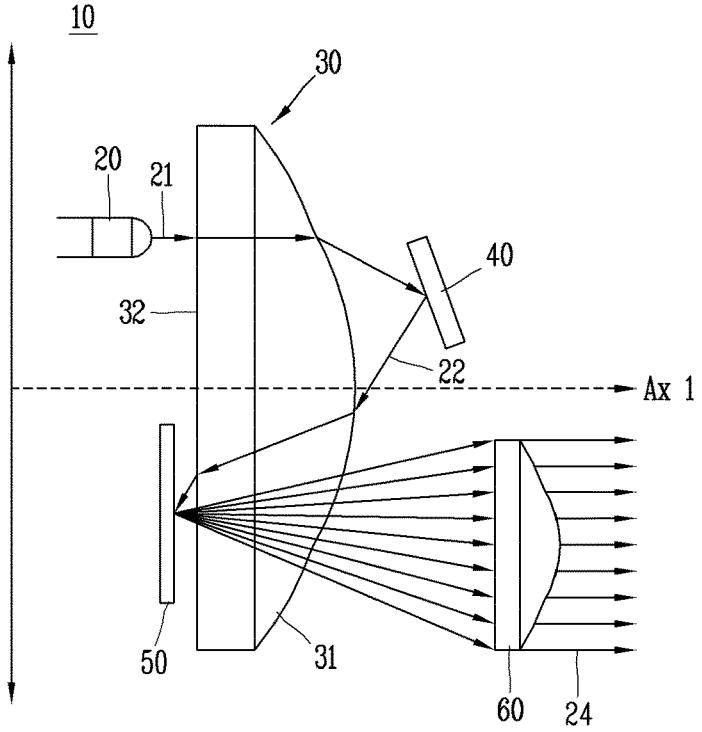
FIG. 4 is a conceptual view showing a traveling path of light within the reflective laser light source illustrated in FIG. 3.

FIG. 3 is a conceptual view showing an example of a reflective laser light source, and FIG. 4 is a conceptual view showing an example of a traveling path of light within the reflective laser light source illustrated in FIG. 3.

In some examples, a laser light source 10 may include the structure of FIG. 3. Referring to FIG. 1, the laser light source 10 may include a blue laser diode 20, a condensing lens 30, a reflector 40, a phosphor module 50, and an auxiliary condenser lens 60.

More specifically, referring to FIG. 4, blue light 21 emitted from the blue laser diode 20 may pass through the condensing lens 30 to be reflected by the reflector 40. The blue light 22 reflected by the reflector 40 passes through the condensing lens 30 to enter the phosphor module 50.

Part of blue light incident on the phosphor module 50 may be converted into yellow light. In some examples, the phosphor module 50 may include a reflective layer, and part of the blue light incident on the phosphor module 50 may be reflected. Accordingly, yellow light and blue light reflected from the phosphor module 50 may be combined to become white light. The white light may be condensed by the auxiliary condenser lens 60, and then emitted 24 to the outside.

In this specification, a laser light source having a structure described in FIGS. 3 and 4 may be referred to as a "reflective laser light source." As described above, the reflective laser light source may include the phosphor module 50.

In some implementations, the phosphor module 50 may include a phosphor layer for converting blue light into yellow light. In some cases, due to the characteristics of a laser diode with high output power, when a resin phosphor or a glass phosphor used in an LED light source or the like for light conversion of the laser diode, thermal quenching may occur in the phosphor.

In some cases, in order to avoid the problem that occurs when laser light is photo-converted using a resin phosphor or a glass phosphor, a ceramic phosphor may be used. However, in the case of the ceramic phosphor, since its sintering temperature is high above 1500° C., it may be difficult to control the particle size and pores of the ceramic phosphor.

When the particle size and pores of the phosphor layer are not controlled, a degree of scattering in the phosphor layer may be increased. When scattering factor increases since the ceramic phosphor is included in the phosphor layer, there is a problem that yellow light is emitted to the periphery of a light emitting area of the laser light source (hereinafter, referred to as a "yellow ring").

The present disclosure provides a structure of a phosphor module capable of minimizing a yellow ring even when using a ceramic phosphor that is difficult to control the degree of scattering.

Specifically, the present disclosure describe a structure that may minimize an area of the phosphor layer included in the phosphor module. When the area of the phosphor layer decreases, the area of the yellow ring may also decrease, but several problems may occur.

First, when the area of the phosphor layer decreases, the light conversion efficiency of the phosphor layer may decrease. Accordingly, when laser light is irradiated to the phosphor module, the brightness of light emitted from the phosphor module may be reduced. For this reason, in a phosphor module in some cases, the area of the phosphor layer may not be reduced to a predetermined level or less.

Second, when the area of the phosphor layer decreases, a contact area between the phosphor layer and the radiating body may be reduced to decrease heat dissipation efficiency, which may cause a thermal quenching phenomenon in the phosphor layer.

The present disclosure describes a structure that may reduce the area of the phosphor layer to a predetermined level or less. Through this, the present disclosure may minimize the area of a yellow ring. Hereinafter, example structures of a phosphor module will be described in detail.

In some implementations, the phosphor module may not emit light by itself, but emit light through light conversion when irradiated with laser light. In the present specification, the expression "brightness of the phosphor module" denotes the brightness of light output from the phosphor module when laser light is irradiated to the phosphor module. In some examples, the brightness of the phosphor module may vary depending on the amount of laser light irradiated to the phosphor module, but the expression "increasing/decreasing the brightness of the phosphor module" in the present specification shows a result of comparing the amounts of light being output when the same amount of laser light is irradiated to the phosphor module.

In some implementations, an upper direction of the phosphor module 200 may be defined as a direction in which a reflective surface reflecting light traveling to the phosphor module faces. Hereinafter, according to these criteria, an upper or lower surface of the components constituting the phosphor module is defined. For example, light directed to a lower side of the phosphor module may not be output to the outside, and light directed to an upper side of the phosphor module may be output to the outside. The amount of light of the phosphor module may be determined according to the amount of light directed toward an upper side of the phosphor module.

Figure 5:
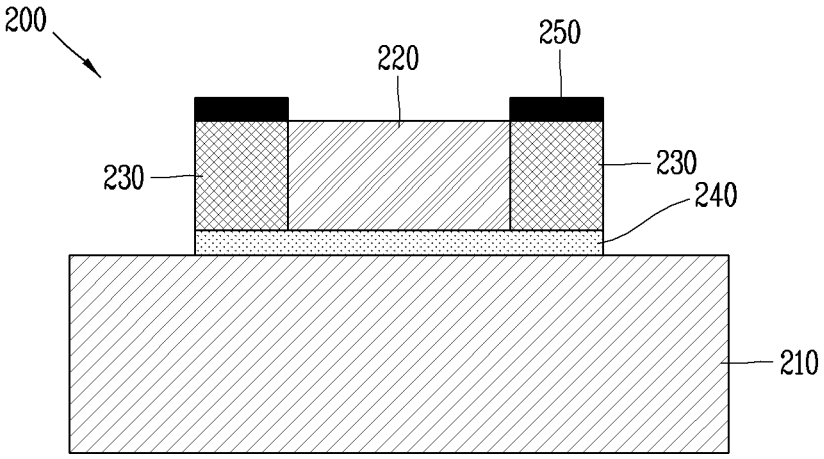
FIGS. 5 through 7 are cross-sectional views showing examples of a phosphor module.
Figure 6:
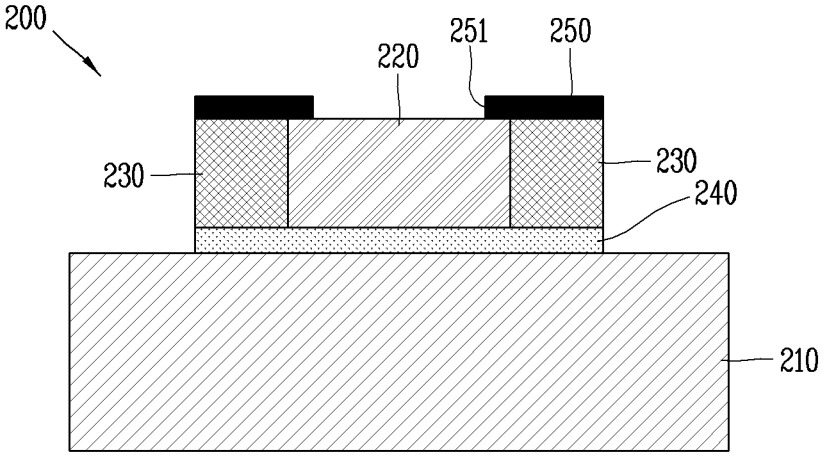
Figure 7:
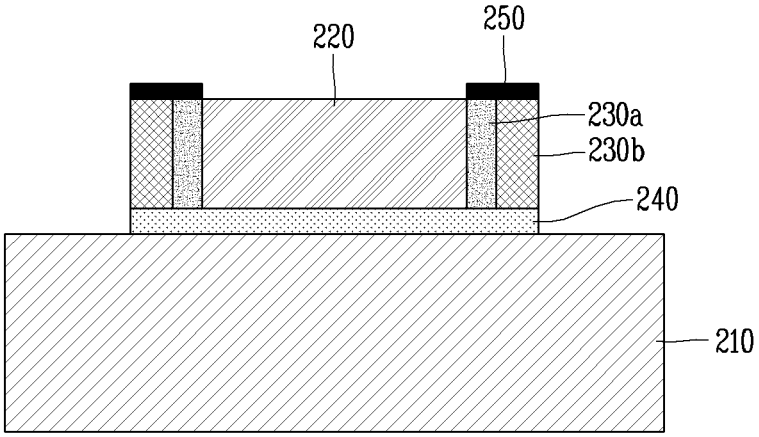

FIGS. 5 through 7 are cross-sectional views showing examples of a phosphor module.

For example, the phosphor module 200 according to the present disclosure may include a radiating body 210, a phosphor layer 220, a reflective layer 230, and an adhesive layer 240. Hereinafter, the above-described components will be described in detail.

The radiating body 210 may be disposed under the phosphor layer 220 to improve the heat dissipation performance of the phosphor module 50. The radiating body 210 may rapidly discharge heat generated during photo-conversion from the phosphor layer 220 to the outside, thereby helping to prevent the phosphor layer 220 from being thermally quenched. As a contact area between the phosphor layer 220 and the radiating body 210 increases, the heat dissipation efficiency of the radiating body 210 may increase. In some examples, the radiating body 210 may be a heat sink.

In some examples, the radiating body 210 may reflect blue light that has passed through the phosphor layer 220 and yellow light emitted from the phosphor layer 220. In some cases, a reflection function of the radiating body 210 may be an additional function. For instance, when a reflective material is disposed between the radiating body 210 and the phosphor layer 220, the radiating body 210 may not need to perform a reflective function.

The radiating body 210 may be made of a metal or alloy having a high thermal conductivity. For example, the radiating body 210 may be made of Al alloys (ADC12, AC4C).

The phosphor layer 220 is disposed above the radiating body 210. The phosphor layer 220 absorbs the irradiated laser light to emit light having a wavelength different from that of the absorbed laser light.

Specifically, the phosphor layer 220 absorbs blue light emitted from a laser diode to emit yellow light. To this end, the phosphor layer 220 may include a yellow phosphor. For example, the phosphor layer 220 may include at least one of YAG: Ce, LuAG: Ce, Sr2SiO4: Eu, and nitride-based yellow phosphors.

In some implementations, the phosphor layer 220 may be made of a mixture of a phosphor and a base material. For example, the phosphor may be sintered and used in a certain form, and the base material may be a material used to secure sinterability for sintering the phosphor. Depending on the type of base material, the type of the phosphor layer may be different. For example, when the base material is a glass frit, the phosphor layer is a glass phosphor, and when the base material is ceramic, the phosphor layer becomes a ceramic phosphor.

Depending on the type of base material, the physical and optical properties of the phosphor layer 220 may vary. Here, the physical properties that may vary depending on the type of base material is a heat dissipation performance of the phosphor layer 220. Compared to the ceramic phosphor, the heat dissipation performance of the glass phosphor is low. When the glass phosphor is used for photo-conversion of laser light having high output power, phosphor contained in the glass phosphor is deteriorated since the glass phosphor does not rapidly release heat energy generated in the photo-conversion process. Specifically, when light is converted into laser light, the temperature of the phosphor layer 220 may increase above 150° C., at which temperature the phosphor may be deteriorated.

In some examples, the physical properties that may vary depending on the type of base material is a degree of scattering in the phosphor layer. The boundaries, pores, and bonds between particles made of base materials may be scattering factors that scatter light photo-converted from the phosphor. When the scattering factors increase in the phosphor layer, the photo-converted yellow light spreads widely around the phosphor module, and thus is emitted to the outside without being combined with blue light. Accordingly, a yellow ring is formed around the laser light source.

An area of the yellow ring decreases as an area of the phosphor layer 220 decreases. The present disclosure uses a ceramic phosphor, but reduces the area of the phosphor layer 220 to minimize the yellow ring.

When the area of the phosphor layer 220 decreases, the foregoing two problems may occur. In order to solve this, the present disclosure includes a reflective layer 230 disposed on a side surface of the phosphor layer 220.

In some examples, as shown in FIG. 5, the reflective layer 230 may surround the side surface of the phosphor layer 220. The role of the reflective layer 230 may be largely divided into two types.

First, the reflective layer 230 serves to reflect light directed toward the side surface of the phosphor layer 220. The reflective layer 230 reflects light traveling toward the side surface of the phosphor layer 220 to travel to an upper side of the phosphor layer 220. Through this, the reflective layer 230 increases a ratio of the amount of light toward the upper side of the phosphor layer 220 to the total amount of yellow light output from the phosphor layer 220. Accordingly, the brightness of the phosphor module may be increased.

In addition, yellow light traveling toward the side surface of the phosphor layer 220 spreads widely around the phosphor module, and the reflective layer 230 reduces the amount of yellow light spreading widely toward the center of the phosphor module to reduce the area of the yellow ring.

As described above, the reflective layer 230 reflects yellow light traveling to the side surface of the phosphor layer 220, thereby increasing the brightness of the phosphor module and reducing the area of the yellow ring.

Second, the reflective layer 230 performs a heat dissipation function for the phosphor layer 220. When the area of the phosphor layer 220 is reduced, the contact area between the phosphor layer 220 and the radiating body 210 may be reduced, thereby decreasing heat dissipation efficiency. In order to compensate for this, the reflective layer 230 emits heat generated from the phosphor layer 220 to the side surface of the phosphor layer 220.

In order for the reflective layer 230 to perform the foregoing two functions, the reflective layer 230 may be made of a material having a high reflectivity and a high thermal conductivity. For example, the reflective layer may be made of at least one of TiO2, Ti2O3, or Al2O3.

In some implementations, the reflective layer 230 may be formed by etching a portion of the previously prepared phosphor layer, and then filling a material constituting the reflective layer 230 in the etched position, and then performing calcination. For this reason, an additional adhesive material need not be disposed between the phosphor layer 220 and the reflective layer 230. However, since the phosphor layer 220 and the radiating body 210 are separately fabricated and assembled, an additional adhesive material may be disposed between the phosphor layer 220 and the radiating body 210.

Specifically, the adhesive layer 240 bonds the phosphor layer 220 and the reflective layer 230 to the radiating body 210. To this end, the adhesive layer 240 is disposed between each of the phosphor layer 220 and the reflective layer 230 and the radiating body 210.

Since the adhesive layer 240 transfers the heat of the phosphor layer 220 and the reflective layer 230 to the radiating body 210, it may be made of a material having a high thermal conductivity. Specifically, a thermal conductivity of the adhesive layer 240 may be higher than those of the phosphor layer 220 and the reflective layer 230. Through this structure, the adhesive layer 240 may quickly transfer the heat of the phosphor layer 220 and the reflective layer 230 to the radiating body 210.

In some examples, when a reflectance of the radiating body 210 is below a predetermined level, the adhesive layer 240 may be made of a material having a high reflectance. For example, the adhesive layer 55 is made of a white bonding material including at least one of Al2O3, SiO2, ZrO2, and ZnO having a reflectance of 90% or more in the visible light region, or made of a metal bonding material containing 90 wt. % of silver or more. The adhesive layer 240 may serve as a reflective layer.

In some examples, when the reflectance of the radiating body 210 is higher than a predetermined level, the adhesive layer 240 may be made of a material having a high light transmittance. For example, the adhesive layer 240 may be made of at least one of poly-methyl methacrylate (PMMA), poly-urethane (PU), poly-carbonate (PC) and a siloxane-based bonding material.

As described above, an area of the phosphor layer used in the phosphor module may be be reduced to a predetermined level or less. Through this, the present disclosure minimizes the area of the yellow ring.

In some examples, when the foregoing reflective layer is applied, the reflective layer reflects part of light incident on the phosphor module to emit blue light to the outside. The present disclosure provides a structure capable of further reducing an area of the yellow ring while avoiding blue noise generated by the reflective layer.

Referring to FIG. 5, a black matrix layer 250 that absorbs light may be layered on the reflective layer. The black matrix layer 250 is disposed at an edge of the phosphor layer 220.

The black matrix layer 250 absorbs the noise peak of blue laser incident on the phosphor module, and absorbs yellow light emitted from the phosphor layer 220 toward the side surface of the phosphor module.

The area of the black matrix layer 250 may be the same as that of the reflective layer 230. The effect that the reflective layer 230 reduces the yellow ring is generated only on the side surface of the reflective layer 230 in contact with the phosphor layer 220. Therefore, an entire upper surface of the reflective layer 230 that may generate unnecessary noise may be preferably covered by the black matrix layer 250. In some implementations, the present disclosure is not limited thereto, the black matrix layer 250 may have a larger area than the reflective layer 230.

For example, referring to FIG. 6, the black matrix layer 250 may extend in the direction toward the phosphor layer 220, and may overlap with a portion of the phosphor layer 220. In this case, the black matrix layer 250 further includes an extension portion 251 overlapping with the phosphor layer 220. In some examples, the black matrix layer 250 may cover an upper surface of the reflective layer 230 and an upper surface of the phosphor layer 220.

Since the yellow ring is likely to be generated by light emitted from an edge of the phosphor layer 220, the extension portion 251 may absorb yellow light emitted from the edge of the phosphor layer 220, thereby minimizing the area of the yellow ring.

In some implementations, the black matrix layer 250 may be made of various materials.

In some examples, the black matrix layer 250 may be made of a glass frit or a mixture of polymer and carbon black, and may be formed by the reflective layer 230 printing method. In some examples, a thickness of the black matrix layer 250 may be adjusted to 5 to 30 μm such that an absorption rate of the black matrix layer 250 may be set to 90 to 96% (reflectance of 4 to 10%).

In some implementations, the black matrix layer 250 may be a diamond-like carbon (DLC) coating layer, and may be coated with Plasma-enhanced chemical vapor deposition (PECVD) equipment at room temperature. In some examples, a thickness of the black matrix layer 250 may be adjusted to 1.5 to 3 μm such that an absorption rate of the black matrix layer 250 may be set to 90 to 96% (reflectance of 4 to 10%).

In some implementations, the black matrix layer 250 may be made of a metal nitride or oxide containing two or more types of metal elements, and may be coated by the physical vapor deposition (PVD) or chemical vapor deposition (CVD) method. In some examples, a thickness of the black matrix layer 250 may be adjusted to 1.5 to 10 μm such that an absorption rate of the black matrix layer 250 may be set to 90 to 96% (reflectance of 4 to 10%).

The present disclosure provides various examples to solve the problems that may occur when reducing the area of the phosphor layer. Hereinafter, examples of the present disclosure will be described with reference to the accompanying drawings.

The present disclosure provides a structure for simultaneously increasing the thermal conductivity and reflectance of the foregoing reflective layer.

FIG. 7 is a cross-sectional view showing an example of a phosphor module including a plurality of reflective layers.

The reflective layer 230 may be configured to rapidly dissipate heat generated from the phosphor layer 220 and reflect light directed toward a side surface of the phosphor layer 220 to an upper side of the phosphor layer 220.

In some examples, the reflective layer 230 may include a plurality of layers. For example, referring to FIG. 7, the reflective layer 230 may include a first reflective layer **230*a* in contact with a side surface of the phosphor layer 220 and a second reflective layer 230*b* surrounding the first reflective layer 230*a***.

Here, the reflectivity of the material constituting the first reflective layer **230*a* may be higher than that of the material constituting the second reflective layer 230*b*. In some implementations, the thermal conductivity of the material constituting the second reflective layer 230*b* may be higher than that of the material constituting the first reflective layer 230*a***.

Through the foregoing first and second reflective layers, the present disclosure may increase the reflectance of the reflective layer while at the same time increasing the thermal conductivity of the entire reflective layer. In some implementations, the first and second reflective layers may have different thicknesses. For example, a width of the first reflective layer **230*a* may be smaller than that of the second reflective layer 230*a*. The first reflective layer 230*a* may be formed only at a thickness sufficient to allow the reflective layer 230 to perform a reflective function, and the second reflective layer 230*b* performing a heat dissipation function may be formed at a large width, thereby maximizing the reflectance and heat dissipation efficiency of the reflective layer 230**.

In some examples, the reflective layer 230 may not include a plurality of layers. Specifically, the reflective layer 230 may be made of a mixture of a material having a high reflectivity and a material having a high thermal conductivity. For example, the reflective layer 230 may be made of a mixture of at least one of alumina (Al2O3), spinel (MgAl2O4), and AlON, and Ti oxide. When a reflective layer is formed by mixing an aluminum oxide material having a high thermal conductivity and a Ti oxide having a high reflectivity, the reflectance and the thermal conductivity of the reflective layer may be increased together.

In some cases, the black matrix layer 250 may be layered on the first and second reflective layers 230*a* and 230*b*, respectively. This structure may help to prevent blue noise from being generated by the first and second reflective layers 230*a* and 230*b*, respectively.

In some examples, the present disclosure may increase the thermal conductivity of the reflective layer using the above-described heat sink.

Figure 8:
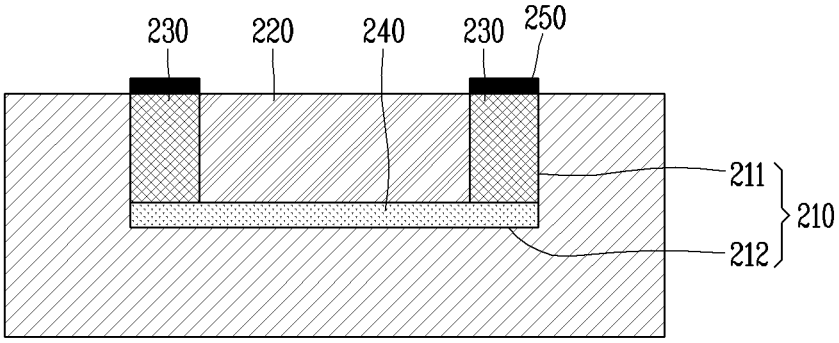
FIGS. 8 and 9 are cross-sectional views showing examples of a phosphor module including a radiating body defining a recess portion.
Figure 9:
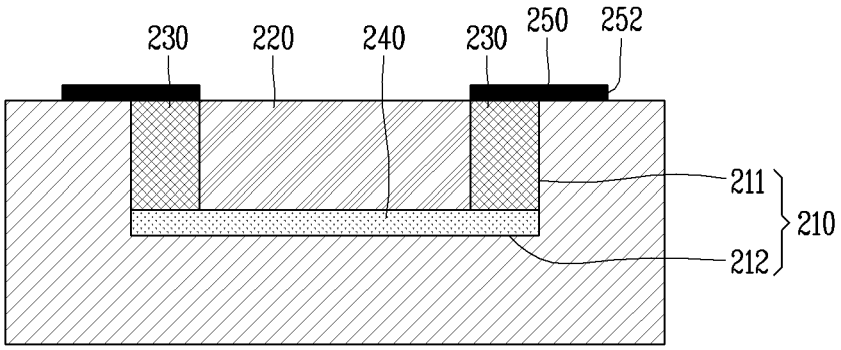

FIGS. 8 and 9 are cross-sectional views showing examples of a phosphor module including a radiating body having a recess portion.

A recess portion may be formed in the radiating body included in the phosphor module. Referring to FIG. 8, the radiating body may be formed with a recess portion having a plurality of side surfaces 211 and a bottom surface 212.

In some examples, the phosphor layer 220 and the reflective layer 230 may be disposed on the bottom surface 212. Here, a thickness of the phosphor layer 220 and the reflective layer 230 may be equal to or smaller than a depth of the recess portion. In this case, the phosphor layer 220 and the reflective layer 230 are disposed within the recess portion.

In some implementations, in order to fix the phosphor layer 220 and the reflective layer 230 to the recess portion, an adhesive layer 240 may be formed on the bottom surface 212 of the recess portion. The adhesive layer 240 transfers heat of each of the phosphor layer 220 and the reflective layer 230 to the radiating body 210. According to the structure described with reference to FIG. 8, since heat of the reflective layer 230 may be discharged to a side surface of the recess portion, the heat dissipation performance of the phosphor module may be improved.

In some examples, the structure described with reference to FIG. 8 may be fabricated by forming a recess portion in the radiating body 210, and then coating an adhesive to a bottom surface of the recess portion, and then placing the phosphor layer 220 and the reflective layer 230 on the coated adhesive. Even in this case, the black matrix layer 250 may be formed on the reflective layer 230. In some examples, the top surface of the radiating body 210 may be flush with a top surface of the reflective layer 230 and a top surface of the phosphor layer 220.

In some implementations, as illustrated in FIG. 9, the black matrix layer 250 may extend from the reflective layer 230 to cover a portion of the radiating body 210. In this case, the black matrix layer 250 may include a second extension portion 252 overlapping with at least part of the radiating body 210.

The second extension portion 252 may help to prevent part of light incident on the phosphor module from being reflected from a surface of the radiating body 210 to generate noise.

In some examples, where the phosphor layer 220 and the reflective layer 230 are disposed within the recess portion defined in the radiating body 210, the durability and heat dissipation performance of the phosphor module may be improved. In addition, the black matrix layer 250 may help to prevent noise from being generated by reflecting blue light from the radiating body and the reflective layer, and reduce the area of the yellow ring.

In some implementations, the phosphor module may further include an additional structure for reducing the area of the yellow ring.

Figure 10:
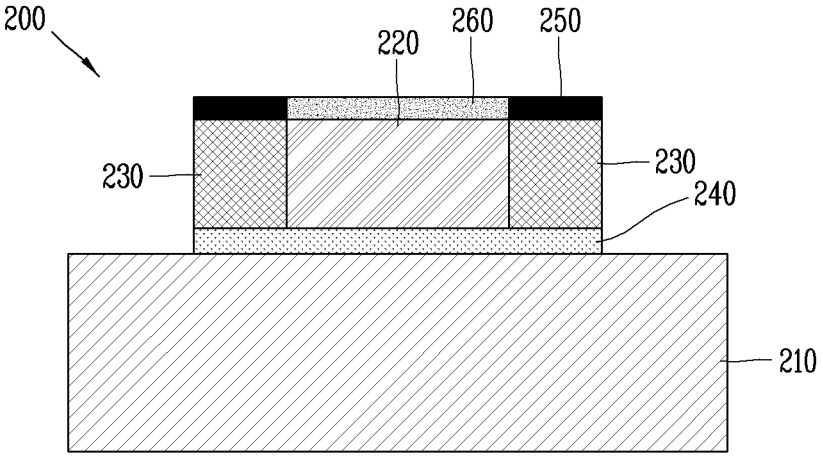
FIGS. 10 through 12 are cross-sectional views showing examples of a phosphor module including a diffuser layer.
Figure 11:
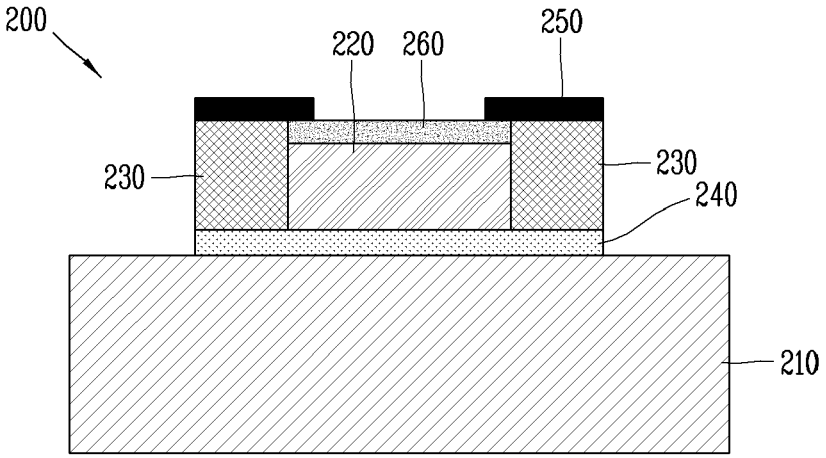
Figure 12:
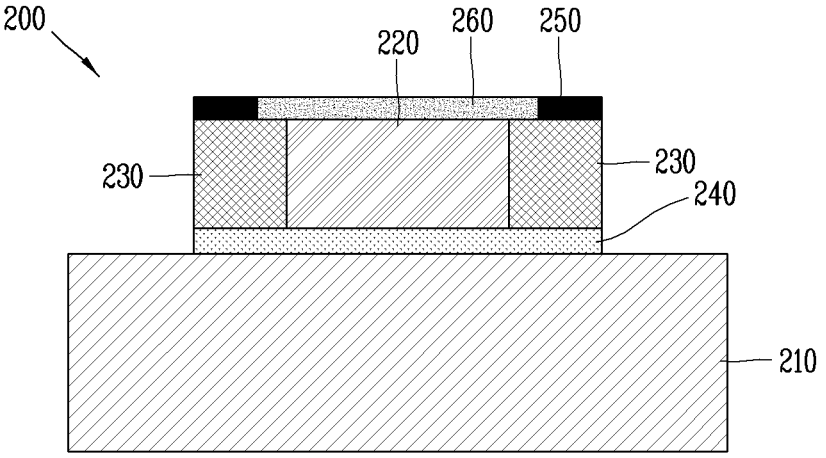

FIGS. 10 through 12 are cross-sectional views showing examples of a phosphor module including a diffuser layer.

Referring to FIG. 10, the present disclosure may further include a diffuser layer 260 layered on the phosphor layer 220 to scatter light. The diffuser layer 260 scatters light emitted from the phosphor layer 220 and light reflected from the phosphor layer 220 to improve color uniformity of white light.

The diffuser layer 260 may be arranged in various forms. For example, as shown in FIG. 10, the diffuser layer 260 may be disposed on the phosphor layer 220, and the black matrix layer 250 may be disposed at an edge of the diffuser layer 260.

In some implementations, referring to FIG. 11, the reflective layer 230 may extend to a side surface of the diffuser layer 260. In some examples, the reflective layer 230 reflects even light emitted to the side surface of the diffuser layer 260. The structure of FIG. 11 is a structure capable of concentrating white light into the center of the phosphor module.

In some cases, the black matrix layer 250 may be disposed to overlap with a portion of the diffuser layer 260. The black matrix layer 250 may absorb light scattered at the edge of the diffuser layer 260 to reduce the area of the yellow ring.

In some implementations, referring to FIG. 12, the diffuser layer 260 may be formed to cover a portion of the upper surface of the reflective layer 230. In this case, the diffuser layer 260 extends from the phosphor layer 220 toward the reflective layer 230. The structure of FIG. 12 is a structure in which white light may be widely spread around the phosphor module.

In some implementations, the diffuser layer 260 may be formed of a mixture of porous silica (particle size of 1 to 5 μm) and a glass frit. The diffuser layer 260 may be fabricated by calcinating the mixture at 500 to 800° C. The diffuser layer may have a thickness of 20 to 100 μm so that the diffuser layer has a transmittance of 85 to 95%.

According to the present disclosure, yellow light traveling toward a side surface of a phosphor layer may be reflected and directed toward a front surface of the phosphor layer, thereby minimizing an area of a yellow ring.

In some examples, the phosphor module may include a black matrix that may absorb yellow light emitted from an edge of the phosphor layer, thereby minimizing the area of the yellow ring. In addition, the black matrix may absorb blue light incident on a reflective layer, thereby disallowing the blue light to be reflected on an upper surface of the reflective layer. Through this, the present disclosure may remove blue noise generated from a phosphor module.

In some examples, the phosphor module may include a diffuser layer that overlaps with the phosphor layer and is configured to uniformly scatter white light, thereby improving the light uniformity of the phosphor module.

It is obvious to those skilled in the art that the present disclosure can be implemented in other specific forms without departing from the concept and essential characteristics thereof.

The detailed description thereof should not be construed as restrictive in all aspects but considered as illustrative. The scope of the disclosure should be determined by reasonable interpretation of the appended claims and all changes that come within the equivalent scope of the disclosure are included in the scope of the disclosure.

What is claimed is:

1. A phosphor module for a laser light source, the phosphor module comprising:

a radiating body;

a phosphor layer disposed at the radiating body, the phosphor layer being configured to absorb light having a first wavelength and emit light having a second wavelength different from the first wavelength;

a reflective layer that surrounds a side surface of the phosphor layer and is configured to reflect light; and a black matrix layer disposed at the reflective layer and configured to absorb light, wherein the black matrix layer is disposed at an edge of the phosphor layer and comprises an extension portion that covers a portion of an upper surface of the phosphor layer, the extension portion overlapping with and facing the portion of the upper surface of the phosphor layer in a light emission direction of the phosphor layer, wherein the reflective layer comprises:

a first reflective layer in contact with the side surface of the phosphor layer, and a second reflective layer that surrounds the first reflective layer, and wherein the black matrix layer is disposed at both of the first reflective layer and the second reflective layer.

2. The phosphor module of claim 1, wherein the extension portion is in contact with the upper surface of the phosphor layer and extends along the upper surface of the phosphor layer, and wherein the light emission direction of the phosphor layer is a vertical direction with respect to the radiating body.

3. The phosphor module of claim 1, wherein the black matrix layer is a diamond-like carbon (DLC) coating layer having a thickness of 1.5 to 3 μm.

4. The phosphor module of claim 1, further comprising:

a diffuser layer disposed on the phosphor layer and configured to scatter light.

5. The phosphor module of claim 4, wherein the diffuser layer is made of porous silica and a glass frit, and has a thickness of 20 to 100 μm.

6. A phosphor module for a laser light source, the phosphor module comprising:

a radiating body;

a phosphor layer disposed at the radiating body, the phosphor layer being configured to absorb light having a first wavelength and emit light having a second wavelength different from the first wavelength;

a reflective layer that surrounds a side surface of the phosphor layer and is configured to reflect light; and a black matrix layer disposed at the reflective layer and configured to absorb light, wherein the black matrix layer is disposed at an edge of the phosphor layer and comprises an extension portion that covers a portion of an upper surface of the phosphor layer, the extension portion overlapping with and facing the portion of the upper surface of the phosphor layer in a light emission direction of the phosphor layer, and wherein the radiating body defines a recess portion that is recessed from a top surface of the radiating body and accommodates the phosphor layer and the reflective layer.

7. The phosphor module of claim 6, wherein the black matrix layer extends from the reflective layer to an upper portion of the radiating body.

8. A phosphor module for a laser light source, the phosphor module comprising:

a radiating body;

a phosphor layer disposed at the radiating body, the phosphor layer being configured to absorb light having a first wavelength and emit light having a second wavelength different from the first wavelength;

a reflective layer that surrounds a side surface of the phosphor layer and is configured to reflect light; and a black matrix layer disposed at the reflective layer and configured to absorb light, wherein the black matrix layer is disposed at an edge of the phosphor layer and comprises an extension portion that covers a portion of an upper surface of the phosphor layer, the extension portion overlapping with and facing the portion of the upper surface of the phosphor layer in a light emission direction of the phosphor layer, wherein the black matrix layer is made of a mixture including carbon black and a glass frit or a polymer material, and wherein the black matrix layer is coated on the reflective layer and has a thickness of 5 to 30 μm.

9. A phosphor module for a laser light source, the phosphor module comprising:

a radiating body;

a phosphor layer disposed at the radiating body, the phosphor layer being configured to absorb light having a first wavelength and emit light having a second wavelength different from the first wavelength;

a reflective layer that surrounds a side surface of the phosphor layer and is configured to reflect light; and a black matrix layer disposed at the reflective layer and configured to absorb light, wherein the black matrix layer is disposed at an edge of the phosphor layer and comprises an extension portion that covers a portion of an upper surface of the phosphor layer, the extension portion overlapping with and facing the portion of the upper surface of the phosphor layer in a light emission direction of the phosphor layer, wherein the black matrix layer is made of metal nitride or metal oxide including two or more metal elements, and wherein the black matrix layer is coated on the reflective layer and has a thickness of 1.5 to 10 μm.

10. A phosphor module for a laser light source, the phosphor module comprising:

a radiating body;

a phosphor layer disposed at the radiating body, the phosphor layer being configured to absorb light having a first wavelength and emit light having a second wavelength different from the first wavelength;

a reflective layer that surrounds a side surface of the phosphor layer and is configured to reflect light;

a black matrix layer disposed at the reflective layer and configured to absorb light; and a diffuser layer disposed on the phosphor layer and configured to scatter light, wherein the black matrix layer is disposed at an edge of the phosphor layer and comprises an extension portion that covers a portion of an upper surface of the phosphor layer, the extension portion overlapping with and facing the portion of the upper surface of the phosphor layer in a light emission direction of the phosphor layer, and wherein the reflective layer extends to a side surface of the diffuser layer.

11. A phosphor module for a laser light source, the phosphor module comprising:

a radiating body;

a phosphor layer disposed at the radiating body, the phosphor layer being configured to absorb light having a first wavelength and emit light having a second wavelength different from the first wavelength;

a reflective layer that surrounds a side surface of the phosphor layer and is configured to reflect light;

a black matrix layer disposed at the reflective layer and configured to absorb light; and a diffuser layer disposed on the phosphor layer and configured to scatter light, wherein the black matrix layer is disposed at an edge of the phosphor layer and comprises an extension portion that covers a portion of an upper surface of the phosphor layer, the extension portion overlapping with and facing the portion of the upper surface of the phosphor layer in a light emission direction of the phosphor layer, wherein the diffuser layer covers at least a part of an upper surface of the reflective layer.

12. The phosphor module of claim 6, wherein the top surface of the radiating body is flush with a top surface of the reflective layer and a top surface of the phosphor layer.

13. The phosphor module of claim 6, wherein the black matrix layer is disposed outside of the phosphor layer.

14. A phosphor module for a laser light source, the phosphor module comprising:

a radiating body;

a phosphor layer disposed at the radiating body, the phosphor layer being configured to absorb light having a first wavelength and emit light having a second wavelength different from the first wavelength;

a reflective layer that surrounds a side surface of the phosphor layer and is configured to reflect light; and a black matrix layer disposed at the reflective layer and configured to absorb light, wherein the black matrix layer is disposed at an edge of the phosphor layer and comprises an extension portion that covers a portion of an upper surface of the phosphor layer, the extension portion overlapping with and facing the portion of the upper surface of the phosphor layer in a light emission direction of the phosphor layer, wherein the radiating body is made of metal or a metal alloy and configured to dissipate heat generated from the phosphor layer, and wherein the reflective layer is made of metal oxide.

15. A phosphor module for a laser light source, the phosphor module comprising:

a radiating body;

a phosphor layer disposed at the radiating body, the phosphor layer being configured to absorb light having a first wavelength and emit light having a second wavelength different from the first wavelength;

a reflective layer that surrounds a side surface of the phosphor layer and is configured to reflect light;

a black matrix layer disposed at the reflective layer and configured to absorb light and an adhesive layer disposed between an upper surface of the radiating body and bottom surfaces of the reflective layer and the phosphor layer, wherein the black matrix layer is disposed at an edge of the phosphor layer and comprises an extension portion that covers a portion of an upper surface of the phosphor layer, the extension portion overlapping with and facing the portion of the upper surface of the phosphor layer in a light emission direction of the phosphor layer.

16. The phosphor module of claim 15, wherein the reflective layer and the phosphor layer are attached to an upper surface of the adhesive layer.

17. The phosphor module of claim 15, wherein the black matrix layer extends from the side surface of the phosphor layer to an outer edge of the reflective layer, and wherein the outer edge of the reflective layer is disposed at an outer surface of the adhesion layer.

18. The phosphor module of claim 15, further comprising:

a diffuser layer disposed on the upper surface of the phosphor layer and configured to scatter light, the diffuser layer being in contact with the black matrix layer.

19. The phosphor module of claim 18, wherein the diffuser layer extends to an upper surface of the reflective layer.

* * * * *